US009933144B2

(12) United States Patent
Mandy et al.

(10) Patent No.: US 9,933,144 B2
(45) Date of Patent: Apr. 3, 2018

(54) LIGHT FIXTURE MOUNTING ASSEMBLY

(71) Applicant: Man-D-Tec, Inc., Scottsdale, AZ (US)

(72) Inventors: Terry Roy Mandy, Paradise Valley, AZ (US); Dalton John Mandy, Scottsdale, AZ (US); Brandon Roy Mandy, Scottsdale, AZ (US); Tyler Flake, Mesa, AZ (US)

(73) Assignee: MAN-D-TEC, INC., Scottsdale, AZ (US)

( * ) Notice: Subject to any disclaimer, the term of this patent is extended or adjusted under 35 U.S.C. 154(b) by 580 days.

(21) Appl. No.: 14/032,723

(22) Filed: Sep. 20, 2013

(65) Prior Publication Data

US 2015/0085499 A1 Mar. 26, 2015

(51) Int. Cl.
*F21V 15/00* (2015.01)
*F21V 21/04* (2006.01)

(52) U.S. Cl.
CPC ..... *F21V 21/046* (2013.01); *F21V 21/042* (2013.01)

(58) Field of Classification Search
CPC ..... F21V 21/046; F21V 21/047
USPC ..... 362/365
See application file for complete search history.

(56) References Cited

U.S. PATENT DOCUMENTS 1,767,988 A 6/1930 Knapp
2,835,791 A 5/1958 Horwitz
3,189,788 A 6/1965 Cady
3,294,977 A 12/1966 Duncan
3,336,473 A 8/1967 Buzan
3,760,179 A 9/1973 Addington, Jr.
3,808,499 A 4/1974 Edwards
4,013,993 A 3/1977 Mandel et al.
4,032,828 A 6/1977 Strobl et al.
4,039,822 A 8/1977 Chan et al.
4,056,757 A 11/1977 Mauch et al.
4,071,749 A 1/1978 Balogh
4,156,891 A 5/1979 Roche
4,218,725 A 8/1980 Heffner et al.
4,223,232 A 9/1980 Bulat
(Continued)

FOREIGN PATENT DOCUMENTS

EP 0495273 A1 7/1992
WO 2003019073 A1 3/2003
(Continued)

OTHER PUBLICATIONS

Installation guide for IP110-F Flush Mount Adapter, Pelco, Inc., Dec. 2008, C2238M, 8 pages.
(Continued)

*Primary Examiner* — Elmito Breval
*Assistant Examiner* — Meghan Ulanday
(74) *Attorney, Agent, or Firm* — Reising Ethington P.C.

(57) ABSTRACT

A light fixture mounting assembly that includes a lamp housing having a sidewall and an opening defined by a rim at one end of the sidewall and a detent extending outward from the sidewall in a position to engage an outer surface of a panel when the housing is in an installed position. A lamp module is carried within the lamp housing and comprises a lamp positioned to emit light through the housing opening. The lamp housing is configured to carry either a spring clip-type retainer or a hose clamp-type retainer to hold the lamp housing in the installed position.

20 Claims, 5 Drawing Sheets

(56) References Cited

U.S. PATENT DOCUMENTS

| | | | | |
|---|---|---|---|---|
| 4,234,907 | A | 11/1980 | Daniel | |
| 4,241,871 | A | 12/1980 | Newell, III et al. | |
| 4,271,621 | A | 6/1981 | Garcia et al. | |
| 4,441,143 | A | 4/1984 | Richardson, Jr. | |
| 4,504,894 | A | 3/1985 | Reibling | |
| 4,520,436 | A | 5/1985 | McNair et al. | |
| 4,587,597 | A | 5/1986 | Meyers | |
| 4,682,078 | A | 5/1987 | Pascilade | |
| 4,697,890 | A | 10/1987 | Crookston et al. | |
| 4,708,223 | A | 11/1987 | Omdorff et al. | |
| 4,727,291 | A | 2/1988 | Bavaria | |
| 4,749,908 | A | 6/1988 | Sifter | |
| 4,751,398 | A | 6/1988 | Ertz, III | |
| 4,802,065 | A | 1/1989 | Minter et al. | |
| 4,875,553 | A | 10/1989 | Smith et al. | |
| 4,885,663 | A | 12/1989 | Parker | |
| 4,890,200 | A | 12/1989 | Mandy | |
| 4,905,579 | A | 3/1990 | Dame | |
| 4,907,132 | A | 3/1990 | Parker | |
| 4,947,291 | A | 8/1990 | McDermott | |
| 4,977,818 | A | 12/1990 | Taylor et al. | |
| 5,003,432 | A | 3/1991 | Mandy | |
| 5,005,108 | A | 4/1991 | Pristash et al. | |
| 5,021,928 | A | 6/1991 | Daniel | |
| 5,025,349 | A | 6/1991 | Gow | |
| 5,123,875 | A | 6/1992 | Eubank et al. | |
| 5,145,247 | A | 9/1992 | Mandy | |
| 5,161,879 | A | 11/1992 | McDermott | |
| 5,253,152 | A | 10/1993 | Yang et al. | |
| 5,408,394 | A | 4/1995 | Mandy | |
| 5,412,542 | A | 5/1995 | Mandy | |
| 5,568,964 | A | 10/1996 | Parker et al. | |
| 5,613,751 | A | 3/1997 | Parker et al. | |
| 5,618,096 | A | 4/1997 | Parker et al. | |
| 5,661,645 | A | 8/1997 | Hochstein | |
| 5,739,639 | A | 4/1998 | Johnson | |
| 5,850,126 | A | 12/1998 | Kanbar | |
| 5,876,107 | A | 3/1999 | Parker et al. | |
| 5,894,686 | A | 4/1999 | Parker et al. | |
| 5,895,115 | A | 4/1999 | Parker et al. | |
| 5,921,652 | A | 7/1999 | Parker et al. | |
| 5,921,670 | A | 7/1999 | Shumacher et al. | |
| 5,966,069 | A | 10/1999 | Zmurk et al. | |
| 6,030,080 | A | 2/2000 | Parker et al. | |
| 6,079,838 | A | 6/2000 | Parker et al. | |
| 6,158,867 | A | 12/2000 | Parker et al. | |
| 6,185,356 | B1 | 2/2001 | Parker et al. | |
| 6,578,808 | B1 * | 6/2003 | Bertagni | H04R 1/025 248/343 |
| 6,609,804 | B2 | 8/2003 | Nolan et al. | |
| 6,712,481 | B2 | 3/2004 | Parker et al. | |
| 6,752,505 | B2 | 6/2004 | Parker et al. | |
| 6,764,196 | B2 | 7/2004 | Bailey | |
| 6,827,456 | B2 | 12/2004 | Parker et al. | |
| 6,860,628 | B2 | 3/2005 | Robertson et al. | |
| 6,872,220 | B2 | 3/2005 | Williams et al. | |
| 6,874,925 | B2 | 4/2005 | Page et al. | |
| 6,994,457 | B2 | 2/2006 | Lee | |
| 7,066,617 | B2 | 6/2006 | Mandy et al. | |
| 7,071,625 | B2 | 7/2006 | Cheng et al. | |
| 7,077,544 | B2 | 7/2006 | Parker | |
| 7,114,829 | B2 | 10/2006 | Lai | |
| 7,114,830 | B2 | 10/2006 | Robertson et al. | |
| 7,246,926 | B2 | 7/2007 | Harwood | |
| 7,261,453 | B2 | 8/2007 | Morejon et al. | |
| 7,396,139 | B2 | 7/2008 | Savage | |
| 7,486,033 | B2 | 2/2009 | Chen et al. | |
| 7,722,227 | B2 | 5/2010 | Zhang et al. | |
| 7,896,517 | B2 | 3/2011 | Mandy et al. | |
| 8,092,035 | B2 | 1/2012 | Mandy et al. | |
| 8,096,672 | B2 | 1/2012 | Mandy et al. | |
| 8,558,407 | B2 | 10/2013 | Mandy et al. | |
| 9,004,713 | B2 | 4/2015 | Mandy et al. | |
| 2004/0125246 | A1 | 7/2004 | Okamori et al. | |
| 2005/0190345 | A1 | 9/2005 | Dubin et al. | |
| 2006/0038192 | A1 | 2/2006 | Williams | |
| 2006/0187654 | A1 | 8/2006 | Jungel-Schmid et al. | |
| 2007/0195532 | A1 | 8/2007 | Reisenauer | |
| 2007/0242461 | A1 | 10/2007 | Reisenauer et al. | |
| 2008/0024010 | A1 | 1/2008 | Romano | |
| 2008/0084700 | A1 | 4/2008 | Van de Ven | |
| 2008/0192489 | A1 | 8/2008 | Ward | |
| 2008/0258628 | A1 | 10/2008 | Higley et al. | |
| 2008/0296975 | A1 | 12/2008 | Shakespeare et al. | |
| 2009/0086474 | A1 * | 4/2009 | Chou | F21S 8/026 362/230 |
| 2009/0290361 | A1 | 11/2009 | Ruud et al. | |
| 2010/0110699 | A1 * | 5/2010 | Chou | F21S 8/026 362/365 |
| 2010/0265725 | A1 * | 10/2010 | Wilcox | F21V 21/04 362/364 |
| 2011/0044047 | A1 | 2/2011 | Mandy et al. | |
| 2011/0299290 | A1 | 12/2011 | Mandy | |
| 2012/0187852 | A1 | 7/2012 | Mandy et al. | |
| 2014/0252948 | A1 | 9/2014 | Mandy et al. | |
| 2014/0268649 | A1 | 9/2014 | Mandy et al. | |
| 2014/0268823 | A1 | 9/2014 | Mandy et al. | |
| 2014/0268829 | A1 | 9/2014 | Mandy et al. | |

FOREIGN PATENT DOCUMENTS

| | | |
|---|---|---|
| WO | 2005098806 | 10/2005 |
| WO | 2006031350 A2 | 3/2006 |

OTHER PUBLICATIONS

Search Report from the Intellectual Property Office for German Application No. GB1204033.3, dated Jun. 14, 2012; 1 page.

* cited by examiner

LIGHT FIXTURE MOUNTING ASSEMBLY

CROSS-REFERENCES TO RELATED APPLICATIONS

Not Applicable

STATEMENT REGARDING FEDERALLY SPONSORED RESEARCH OR DEVELOPMENT

Not Applicable

BACKGROUND

Field

This application relates generally to light fixture mounting assemblies for supporting a light fixture in a panel having a through-hole for receiving such a fixture.

Description of Related Art Including Information Disclosed Under 37 CFR 1.97 and 1.98

Light fixture mounting assemblies configured to support a light fixture in a ceiling panel are generally designed to be inserted into a ceiling panel through-hole from below the ceiling panel, but differ in that they are adapted to be secured in the through-hole either from above or from below the ceiling panel. Securing a light fixture from above a ceiling panel requires access to the space above the ceiling panel which, in some cases, may be inconvenient or impossible—discouraging or preventing the use of a light fixture mounting assembly adapted to be secured from above. Since light fixture mounting assemblies adapted to be secured from above are known to be incompatible with being secured from below, light fixtures have been adapted specifically to be secured from below and without requiring any access to the space above a ceiling panel. But these designs are known to be incompatible for installation from above. This can be problematic where, for example, designers wish to standardize fixtures across areas with different ceiling access availability.

SUMMARY

A light fixture mounting assembly is provided for supporting a light fixture in a panel having a through-hole for receiving such a fixture. The assembly comprises a lamp housing having a sidewall and an opening defined by a rim at one end of the sidewall. The housing is configured to be received into an installed position in a hole in a panel. The assembly further comprises a detent extending outward from the sidewall in a position to engage an outer surface of the panel when the housing is in the installed position. A lamp module is carried within the lamp housing, and comprises a lamp positioned to emit light through the housing opening. The lamp housing is configured to carry a spring clip-type retainer arranged to hold the lamp housing in the installed position, and to carry a hose clamp-type retainer arranged to hold the lamp housing in the installed position.

DRAWING DESCRIPTIONS

These and other features and advantages will become apparent to those skilled in the art in connection with the following detailed description and drawings of one or more embodiments of the invention, in which.

DETAILED DESCRIPTION

Figure 1:
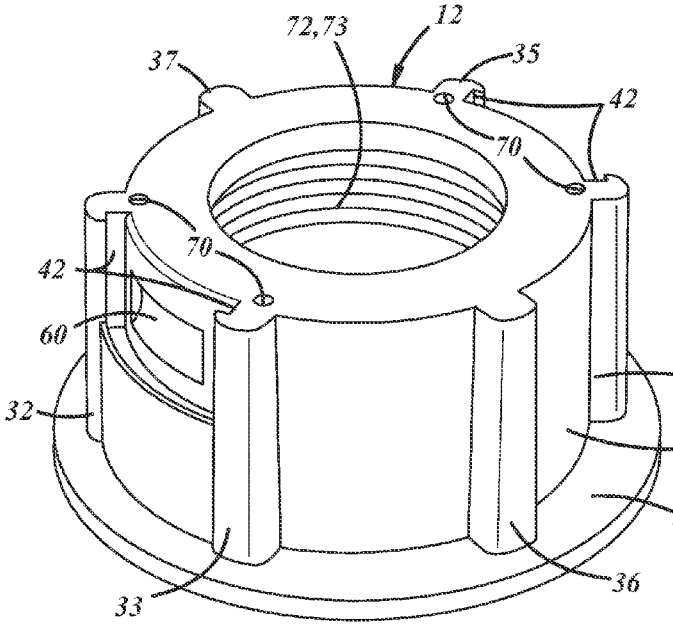
FIG. 1 is a perspective view of a light fixture housing of a light fixture mounting assembly.
Figure 2:
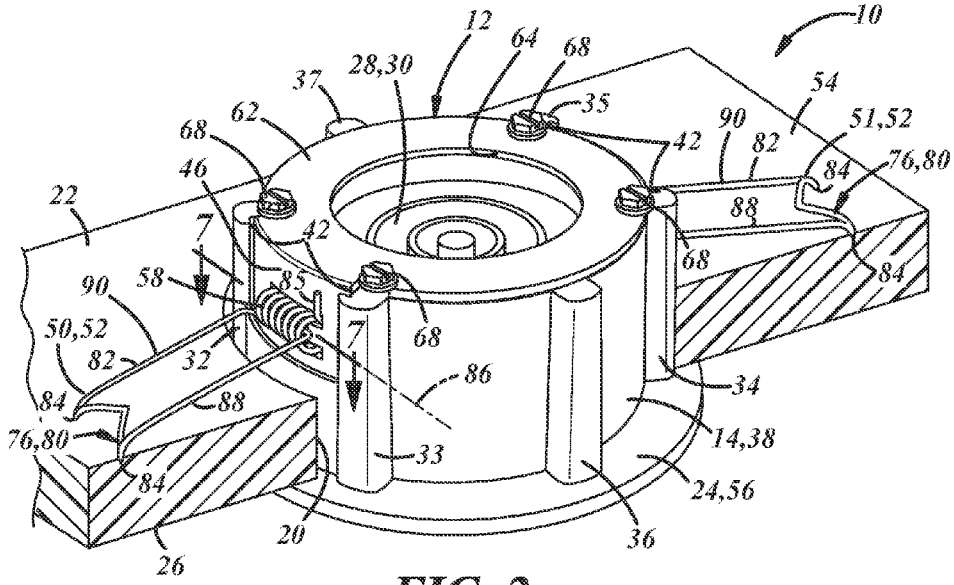
FIG. 2 is a partial-cutaway perspective view of a light fixture mounting assembly including the housing of FIG. 1 carrying a lamp module, received in a through-hole in a ceiling panel, and supported on the ceiling panel by spring clips and spring clip mounting hardware of the light fixture mounting assembly.
Figure 3:
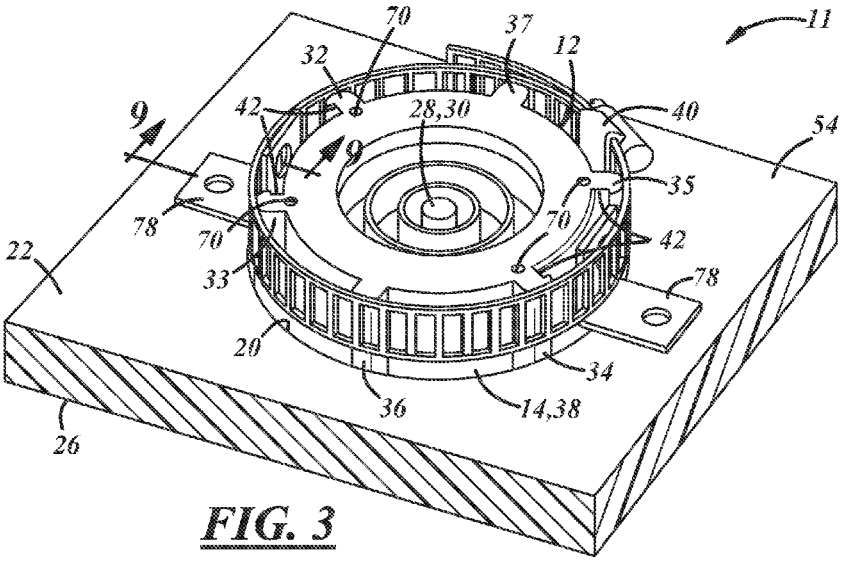
FIG. 3 is a perspective view of an alternative light fixture mounting assembly including the housing of FIG. 1 carrying a lamp module, received in a through-hole in a ceiling panel, and supported on the ceiling panel by a hose-clamp-type retainer of the alternative mounting assembly.
Figure 4:
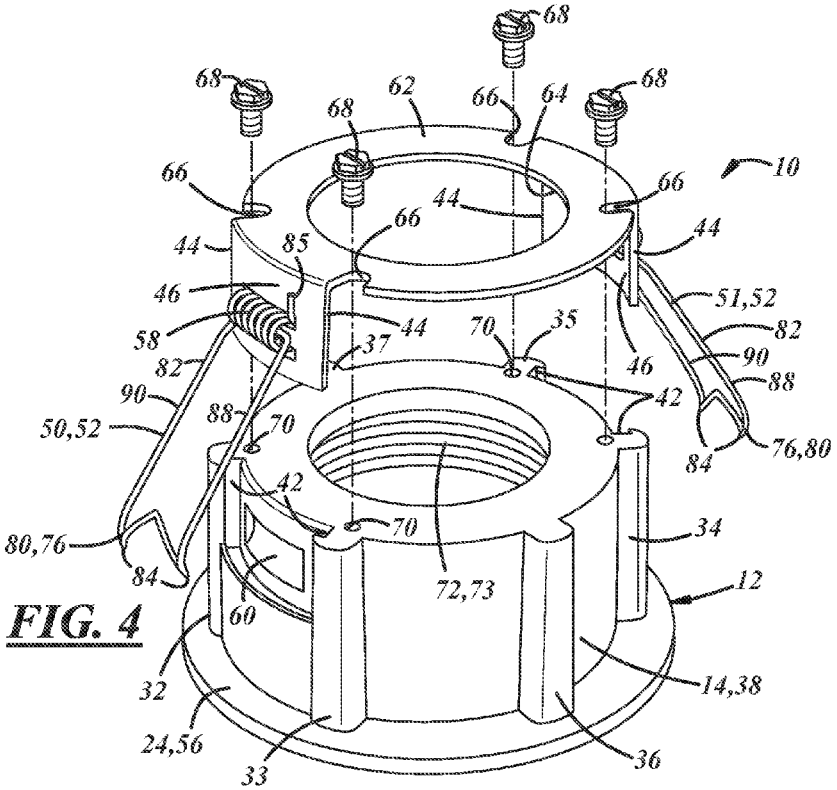
FIG. 4 is a partially-exploded perspective view of the mounting assembly of FIG. 2 removed from the ceiling panel.
Figure 5:
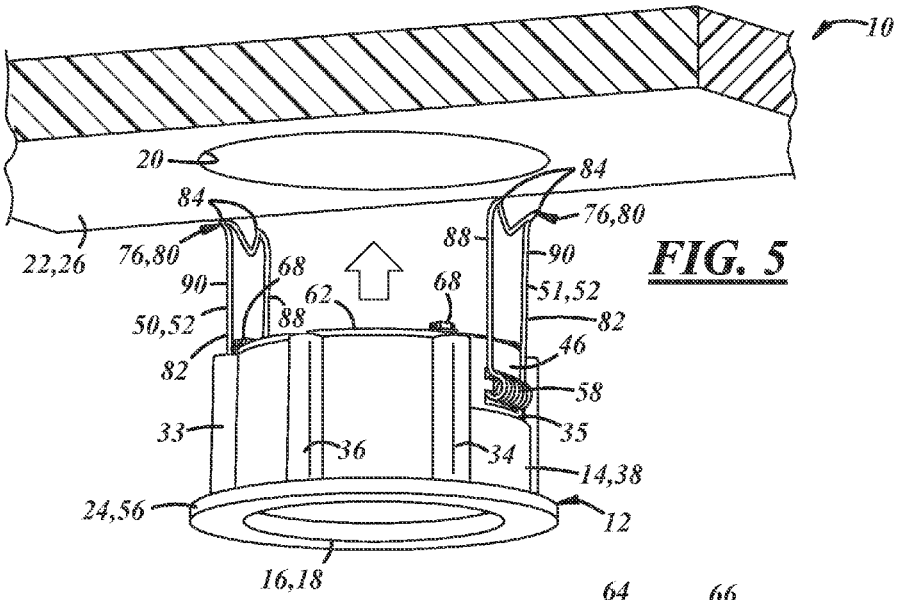
FIG. 5 is a perspective view of the mounting assembly of FIG. 2 with spring clips retracted for insertion into a ceiling panel hole.
Figure 6:
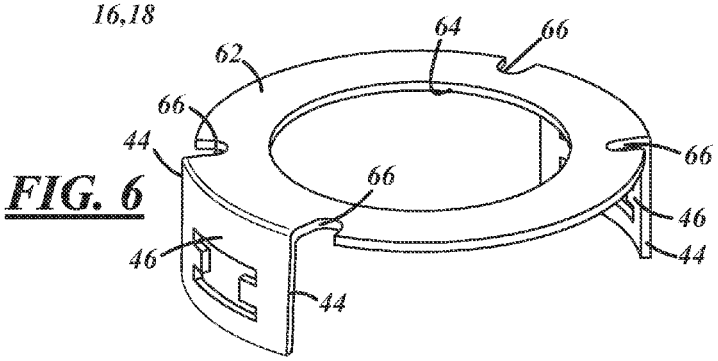
FIG. 6 is a perspective view of a spring clip connecting member and carrier plates of the mounting assembly of FIG. 2.

A first light fixture mounting assembly for supporting a light fixture in a panel having a through-hole for receiving such a fixture is generally shown at 10 in FIGS. 1, 2, and 4-8. A second light fixture mounting assembly is generally shown at 11 in FIGS. 3 and 9. As best shown in FIGS. 3 and 5, both the first mounting assembly 10 and the second mounting assembly 11 may include the same lamp housing 12. In other words, the lamp housing 12 may be common to both the first and the second mounting assemblies.

The lamp housing 12 may include a sidewall 14 and an opening 16 defined by a rim 18 at one end of the sidewall 14. The housing 12 may be configured to be received into an installed position in a through-hole 20 in a panel such as a ceiling panel 22. A detent 24 may extend outward from the sidewall 14 in a position to engage an outer surface 26 of the panel 22, e.g., a lower surface 26 of a ceiling panel 22, when the housing 12 is in the installed position in the through-hole 20. As best shown in FIG. 2, a lamp module 28 may be carried within the lamp housing 12 and may comprise a lamp 30 positioned to emit light through the housing opening 16. The housing 12 may comprise first and second ribs 32, 33 standing laterally outward from an outer surface 38 of the sidewall 14 of the housing 12. As best shown in FIG. 3, the first and second ribs 32, 33 may be spaced apart and oriented generally axially and parallel to one another to facilitate the optional securing of the housing 12 from inside or above the panel 22 via the second mounting assembly 11. The ribs 32, 33 facilitate light fixture installation using the second mounting assembly 11, by reinforcing the housing 12 against cinching forces applied by a hose clamp-type retainer of the second mounting assembly 11. As best shown in FIG. 1, the first and second ribs 32, 33 may comprise respective side slots 42 positioned to receive respective opposite side edges 44 of a spring clip carrier panel 46 of a spring clip-type retainer 48 of the first light fixture mounting assembly 10, thus facilitating optional light fixture installation using the spring clip-type retainer 48 of the first mounting assembly 11.

As best shown in FIG. 5, the lamp housing 12 may be generally cylindrical in shape and may be configured to be received in the panel through-hole 20, which may be of slightly greater diameter than the housing 12. The sidewall 14 may be generally circumferential, and the opening 16 defined by the rim 18 may be generally circular. The detent 24 may comprise an annular flange 56 extending integrally and radially outward from around the circumferential sidewall 14 at or adjacent the rim 18, and the first and second ribs 32, 33 may stand radially outward from an outer surface 38 of the circumferential sidewall 14. The first and second ribs 32, 33 may be integrally formed with the housing 12 as a single unitary piece.

As best shown in FIG. 4, the first mounting assembly 10 may include a first spring clip 50 comprising a first spring clip carrier panel 46 having opposite, generally parallel side edges 44 received by the respective side slots 42 of the first and second ribs 32, 33. The first spring clip 50 and carrier panel 46 may be configured to allow the housing 12 to be inserted into the panel through-hole 20 with a spring-biased arm 52 of the first spring clip 50 rotated upward and inward against spring bias from a deployed position, as shown in FIG. 2, to a cocked position as shown in FIG. 5. Initially, during housing insertion into the panel through-through-hole 20, the first spring clip 50 may be retained in or near the cocked position by the panel through-hole 20 while passing through the panel through-hole 20. The first spring clip 50 may be further configured to resist withdrawal of the lamp housing 12 from the panel through-hole 20 as a result of first spring clip arm rotation outward under spring bias from the cocked position to a deployed position as shown in FIG. 2. In the deployed position a distal friction surface 76 of the first spring clip arm 52 may be engaged against an inner or upper surface 54 of the ceiling panel 22, having deployed to that position once the first spring clip arm 52 passed through the through-hole 20.

As best shown in FIG. 4, the housing 12 may include third and fourth ribs 34, 35 that may be integrally formed with the housing 12 as a single unitary piece. The third and fourth ribs 34, 35 may stand integrally and radially outward from the outer surface 38 of the circumferential side wall 14 of the housing 12, may be disposed on a portion of the circumferential sidewall 14 diametrically opposite the first and second ribs 32, 33, and may be spaced apart from each other and from the first and second ribs 32, 33 and oriented generally axially and parallel to one another to cooperate with the first and second ribs 32, 33 in reinforcing the housing 12 against cinching forces from the hose clamp-type retainer 40 when such a retainer is used as shown in FIG. 3. As shown in FIG. 4, the third and fourth ribs 34, 35 may comprise respective side slots 42 positioned to receive respective opposite side edges 44 of a spring clip carrier panel 46 to facilitate the optional mounting of a second spring clip-type retainer 51 to the housing 12.

As shown in FIG. 4, the first mounting assembly 10 may include a second spring clip 51 comprising a second spring clip carrier panel 46 having opposite, generally parallel side edges 44 received by the respective side slots 42 of the third and fourth ribs 34, 35. The second spring clip 51 and carrier panel 46 may be configured to allow the housing 12 to be inserted into the panel through-hole 20 with a spring-biased arm 52 of the second spring clip 51 rotated upward and inward against spring bias from a deployed position shown in FIG. 2, to a cocked position shown in FIG. 5. The second spring clip 51 may be retained in or near the cocked position by the panel through-hole 20 while passing through the panel through-hole 20. The second spring clip 51 may be further configured to resist withdrawal of the lamp housing 12 from the panel through-hole 20 as a result of second spring clip arm rotation outward under spring bias from the cocked position to the deployed position in which a distal friction surface 76 of the second spring clip arm may be engaged against an inner or upper surface 54 of the ceiling panel 22, having deployed to that position once the second spring clip arm 52 passed through the through-hole 20.

Each spring clip 50, 51 may include a spring 58 carried by the carrier panel 46 of each spring clip 50, 51 and configured to bias the arm 52 of each spring clip 50, 51 downward toward its deployed position. The housing 12 may include semi-cylindrical recesses 60 formed into the sidewall 14 and shaped to accommodate the springs 58 carried by the spring clip carrier panels 46. The carrier panels 46 may have arcuate shapes complementing the outer surface 38 of the housing sidewall 14, which may be arcuate as well.

The distal friction surface 76 which may be positioned on each spring clip 50, 51, may be configured to resist rotational forces imparted to the housing 12 as the lamp module 28 is being screwed into or out of the housing 12. The friction surface 76 may resist such rotational forces by enhancing each spring clip's grip on the ceiling panel upper surface 54. The spring clips 50, 51 may thus provide enough rotational resistance to allow lamp modules 28 to be installed and uninstalled without causing the entire first mounting assembly 10 to rotate relative to the panel 22.

As best shown in FIG. 4, the first mounting assembly 10 may include a spring clip connecting member 62 interconnecting the first and second spring clips 50, 51. The connecting member 62 may be integrally formed with the carrier panels 46 of the first and second spring clips 50, 51 as a single unitary piece. The connecting member 62 may be annular in shape, having an axial through-hole 64 shaped and positioned to allow for convective heat transfer from the lamp 30 carried by the housing 12. The spring clip connecting member 62 may include notches 66 configured to receive fasteners 68, and the housing 12 may include holes 70 configured to receive the fasteners 68, allowing the spring clip connecting member 62, carrier panels 46, and spring clips 50, 51, to be secured to the housing 12. In the present embodiment the fasteners 68 are screws and the holes 70 in the housing 12 are threaded to receive the screws 68 in threaded engagement.

As best shown in FIG. 1 the housing 12 may include fifth and sixth ribs 36, 37 integrally formed with the housing 12 as a single unitary piece and standing integrally and radially outward from the outer surface 38 of the circumferential side wall 14 of the housing 12. The fifth and sixth ribs 36, 37 may be disposed diametrically opposite one another, with the fifth rib 36 being spaced between the first 32 and third ribs 34 and the sixth rib 37 being spaced between the second 33 and fourth 35 ribs to cooperate with the first, second, third, and fourth ribs 32, 33, 34, 35 in reinforcing the housing 12 against cinching forces when a hose clamp-type retainer 40 is used as shown in FIG. 3.

The housing 12 may comprise die-cast aluminum and the ribs 32-37 of the housing 12 may be configured to reject heat via convection to ambient air. The lamp module 28 may also comprise die-cast aluminum and the housing 12 and lamp module 28 may be configured to conduct heat from the lamp module 28 to the ribs 32-37. In other words, heat generated by LED lamps is conducted through the lamp module 28 into the housing sidewall 14, and from the housing sidewall 14 into the ribs 32-37 where the heat is then rejected via convection to the atmosphere. In other embodiments the housing 12 and lamp module 28 need not comprise aluminum but may, instead, comprise any other suitable heat-conducting material in applications where the housing 12 is intended to cooperate in rejecting heat from the lamp module 28. Where a metal such as aluminum is used, the housing 12 and lamp module 23 need not be die cast but may, instead, be formed by any other suitable means.

Figure 8:
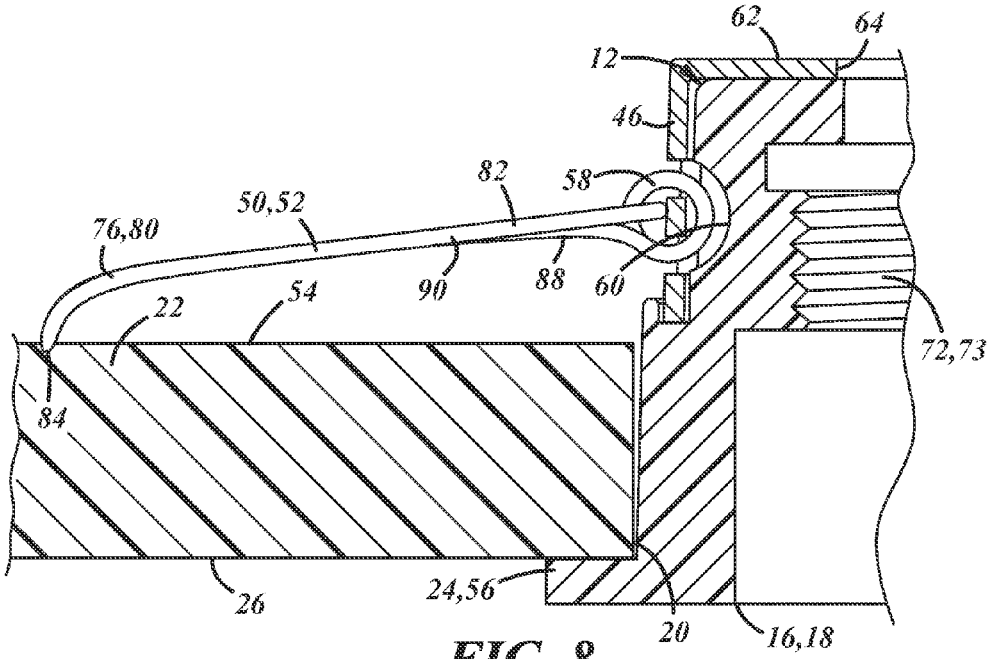
FIG. 8 is a fragmentary cross-sectional view of the mounting assembly of FIG. 2 taken along line 8-8 of FIG. 7.
Figure 9:
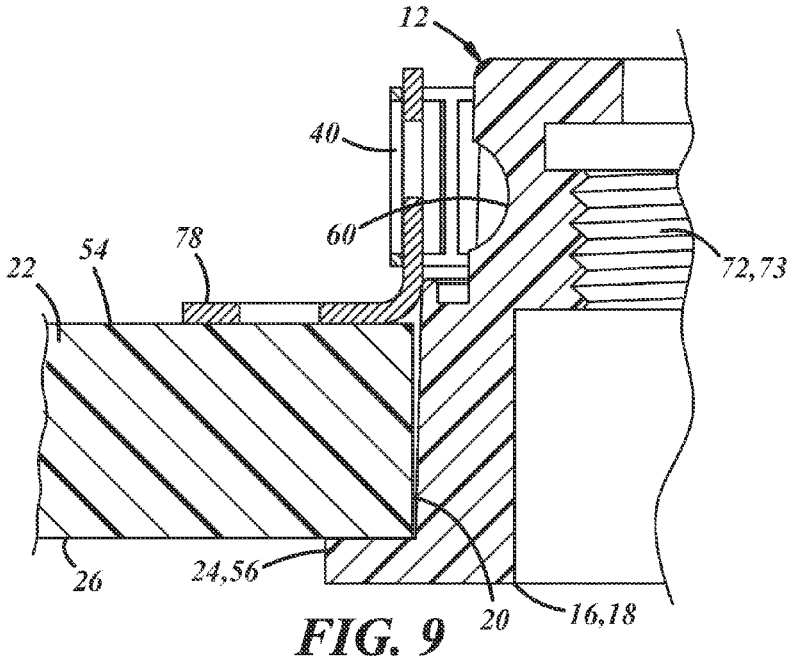
FIG. 9 is a fragmentary cross-sectional view of the alternative mounting assembly of FIG. 3 taken along line 9-9 of FIG. 3.

As best shown in FIGS. 8 and 9, the housing 12 may include housing threads 72 on an inner circumferential surface 73 of the housing 12, which may be configured to threadedly engage module threads (not shown) on an outer circumferential surface (not shown) of the lamp module 28. The threads 72 allow the lamp module 28 to be installed in and removed from the housing 12 from below without having to remove the housing 12 or gain access from above.

Figure 7:
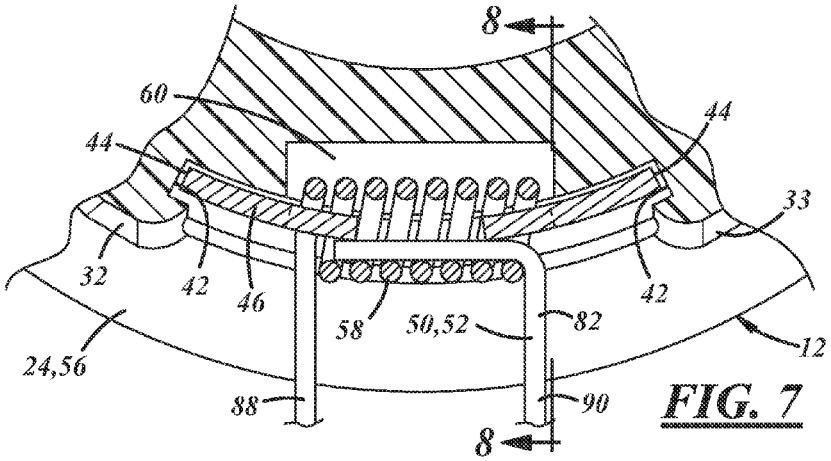
FIG. 7 is a magnified fragmentary cutaway view of the mounting assembly of FIG. 2 showing an interface of the spring clip and spring clip carrier panel.
Figure 10:
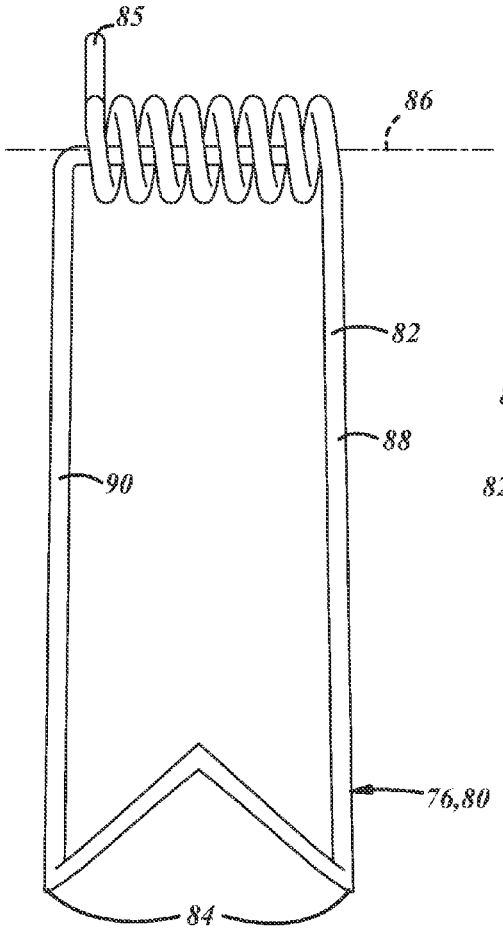
FIG. 10 is a bottom view of one of the spring clips of the mounting assembly of FIG. 2.
Figure 11:
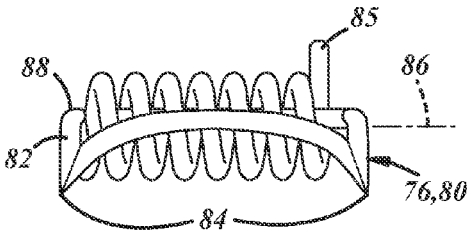
FIG. 11 is an end view of the spring clip of FIG. 10.
Figure 12:
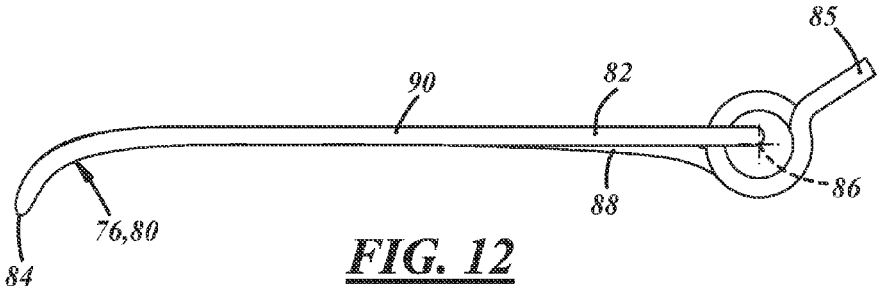
FIG. 12 is a side view of the spring clip of FIG. 10.

The friction surface 76 at the distal end of the arm 52 of each spring clip 50, 51 may include a claw 80 configured to engage the ceiling panel 22 by digging into the upper surface 54 of the ceiling panel 22 as shown in FIGS. 2 and 8. With the claws 80 dug into the ceiling panel 22, the spring clips 50, 51 are able to resist rotation of the lamp housing 12 within the panel through-hole 20 when the lamp module 28 is being installed in or removed from the lamp housing 12. The claw 80 of the spring clip arm 52 may include a wire 82 bent sharply into acute angles to form at least two downwardly-arched tines 84 at the distal end of the arm 52 of each spring clip 50, 51 as best shown in FIGS. 2, 4, 11, and 12. The wire 82 may be coiled to form the spring 58 at an inner end opposite the distal end of the arm 52 of each spring clip 50, 51, with a first end 85 of the wire 82 bent straight to provide an engagement surface to anchor one end of the spring 58 as shown in FIGS. 2 and 4. This allows biasing force to be developed when the arm 52 is rotated around a central spring axis 86. Where it extends from the spring 58 the wire 82 includes a first straight length 88 that terminates in the claw 80, where the wire 82 is sharply bent in three places to form the general shape of the capital letter "M" as best seen in plan view in FIG. 10. The upper two corners of the M define the two tines 84. Where it extends back toward the spring 58 from the claw 80, the wire 82 includes a second straight length 90 spaced from and disposed generally parallel to the first straight length. As is best shown in FIGS. 7, 10, and 11, at the end of the second straight length the wire 82 turns approximately 90 degrees and extends through the coils of the spring 58. The claw 80 is arched both as viewed from the side in FIG. 12 and as viewed from the distal end in FIG. 11.

In practice, the first mounting assembly 10 may be used to support a light fixture in a panel 22 having a through-hole 20 for receiving such a fixture, by first mounting the spring clips 50, 51 to the housing 12, then rotating and retaining the arms 52 of the first and second spring clips 50, 51 upward and inward against spring bias to their respective cocked positions, then inserting the spring clips along with an upper portion of the housing 12 into the ceiling panel through-hole 20 such that the through-hole 20 is at least initially able to retain the spring clips 50, 51 in or near their cocked positions, allowing any previous means of spring clip retention (e.g.: manual retention) to be released. Insertion of the first mounting assembly 10 may be continued until the housing detent 24 engages the ceiling panel lower surface 26 and the spring clips 50, 51 are free to deploy and engage the ceiling panel upper surface 54.

Alternatively, the second mounting assembly 11 may be used to support a light fixture in a panel through-hole 20 by placing one or more angle brackets 78 of the second mounting assembly 11 around the panel hole 20, and inserting an upper portion of the housing 12 into the through-hole 20 until the housing detent 24 engages the panel lower surface 26. The angle brackets 78 may then be moved against the housing sidewall 14 and secured to the housing by positioning a strap of a hose clamp-type retainer 40 of the second mounting assembly 11 around the housing 12 and brackets 78, then tightening the retainer 40 until its strap is holding the angle brackets 78 tightly against the housing sidewall 14. Secured to the housing 12 in this way, the angle brackets 78 prevent the housing 12 from falling through the panel through-hole 20.

Using either the first or second light fixture mounting assembly described above, a light fixture may be installed from below a ceiling panel and then secured in position either from above or below the ceiling panel. A single housing design thus accommodates two different mounting schemes, allowing the installation method to be chosen to suit the installation environment.

This description, rather than describing limitations of an invention, only illustrates an embodiment of the invention recited in the claims. The language of this description is therefore exclusively descriptive and is non-limiting. Obviously, it's possible to modify this invention from what the description teaches. Within the scope of the claims, one may practice the invention other than as described above.

What is claimed is:

1. A light fixture mounting assembly for supporting a light fixture in a panel having a through-hole for receiving such a fixture, the assembly comprising:

a lamp housing having a sidewall and an opening defined by a rim at one end of the sidewall, the housing being receivable into an installed position in a hole in a panel and further comprising a detent extending outward from the sidewall in a position to engage a lower surface of the panel when the housing is in the installed position;

a lamp module carried within the lamp housing and comprising a lamp positioned to emit light through the housing opening;

the assembly comprising at least one of:

a spring clip-type retainer carried by the lamp housing and comprising an arm and a spring that biases the arm downward into a deployed position against an upper surface of the panel in such a way as to bias the lamp housing upward toward the installed position, the arm being rotatable against spring bias to an upwardly-extending cocked position allowing the retainer to pass through the hole when the housing is inserted through the hole into the installed position; or a hose clamp-type retainer engageable around the lamp housing sidewall in a position holding the lamp housing in the installed position.

2. A light fixture mounting assembly for supporting a light fixture in a panel having a through-hole for receiving such a fixture, the assembly comprising:

a lamp housing having a sidewall and an opening defined by a rim at one end of the sidewall, the housing being receivable into an installed position in a hole in a panel and further comprising a detent extending outward from the sidewall in a position to engage a lower surface of the panel when the housing is in the installed position;

a lamp module carried within the lamp housing and comprising a lamp positioned to emit light through the housing opening;

the assembly comprising at least one of:

a spring clip-type retainer carried by the lamp housing and comprising an arm positioned to engage an upper surface of the panel in such a way as to bias the lamp housing upward toward the installed position; or a hose clamp-type retainer engageable around the lamp housing sidewall in a position holding the lamp housing in the installed position; and the housing comprising first and second ribs standing laterally outward from an outer surface of the side wall of the housing, spaced apart and oriented generally axially and parallel to one another and comprising respective side slots positioned to receive respective opposite side edges of a spring clip carrier panel.

3. A light fixture mounting assembly as defined in claim 2 in which first and second ribs are integrally formed with the housing as a single unitary piece.

4. A light fixture mounting assembly as defined in claim 2 in which the lamp housing is generally cylindrical in shape and is configured to be received in a circular hole in a panel of slightly greater diameter, the sidewall is generally circumferential, the opening defined by the rim is generally circular, the detent comprises an annular flange extending integrally and radially outward from around the circumferential sidewall at or adjacent the rim, and the first and second ribs stand radially outward from an outer surface of the circumferential side wall.

5. A light fixture mounting assembly as defined in claim 2 in which the assembly includes a first spring clip carried by the housing and configured to engage the panel in such a way as to hold the lamp housing in the installed position.

6. A light fixture mounting assembly as defined in claim 5 in which the spring clip comprises an arm biased toward a deployed position in which a distal end of the arm engages the upper surface of a panel when the housing is in an installed position in a hole in the panel, the distal end of the arm including a claw configured to engage the panel in such a way as to resist rotation of the housing within the panel hole.

7. A light fixture mounting assembly as defined in claim 6 in which the claw of the spring clip arm includes a wire bent to form at least two tines at the distal end of the arm.

8. A light fixture mounting assembly as defined in claim 5 in which the first spring clip comprises a first spring clip carrier panel having opposite, generally parallel side edges received by the respective side slots of the first and second ribs and configured to allow the housing to be inserted into the panel hole with a spring-biased arm of the first spring clip rotated inward against spring bias to a cocked position, and further configured to resist withdrawal of the lamp housing from the panel hole as a result of first spring clip arm rotation outward under spring bias to a deployed position against an inner surface of the panel once the first spring clip arm has passed through the hole.

9. A light fixture mounting assembly as defined in claim 2 in which:

the housing includes third and fourth ribs standing outward from the outer surface of the side wall of the housing, spaced apart and oriented generally axially and parallel to one another, and comprising respective side slots positioned to receive respective opposite side edges of a spring clip carrier panel; and the assembly includes a second spring clip comprising a second spring clip carrier panel having opposite, generally parallel side edges received by the respective side slots of the third and fourth ribs and configured to allow the housing to be inserted into the panel hole with a spring-biased arm of the second spring clip rotated inward against spring bias to a cocked position, and further configured to resist withdrawal of the lamp housing from the panel hole as a result of second spring clip arm rotation outward under spring bias to a deployed position against an inner surface of the panel once the second spring clip arm has passed through the hole.

10. A light fixture mounting assembly as defined in claim 8 in which:

the lamp housing is generally cylindrical in shape and is configured to be received in a circular hole in a panel of slightly greater diameter;

the lamp housing sidewall is generally circumferential;

the opening defined by the lamp housing rim is generally circular, the lamp housing detent comprises an annular flange extending integrally and radially outward from around the circumferential sidewall at or adjacent the rim, and the first, second, third, and fourth lamp housing ribs stand radially outward from an outer surface of the circumferential side wall, and the third and fourth ribs are disposed on a portion of the circumferential sidewall diametrically opposite the first and second ribs.

11. A light fixture mounting assembly as defined in claim 9 in which the housing includes fifth and sixth ribs standing radially outward from the outer surface of the circumferential side wall of the housing with the fifth rib being spaced between the first and third ribs and the sixth rib being disposed between the second and fourth ribs.

12. A light fixture mounting assembly as defined in claim 8 in which the assembly includes a spring clip connecting member interconnecting the first and second spring clips.

13. A light fixture mounting assembly as defined in claim 11 in which the connecting member is integrally formed with the carrier panels of the first and second spring clips as a single unitary piece.

14. A light fixture mounting assembly as defined in claim 12 in which the connecting member is annular in shape having an axial through-hole shaped and positioned to allow for convective heat transfer from a lamp carried by the housing.

15. A light fixture mounting assembly as defined in claim 2 in which:

the housing comprises a thermally conductive material and the housing ribs are configured to reject heat via convection to ambient air;

the lamp module comprises a thermally conductive material; and the housing and lamp module are configured to conduct heat from the lamp module to the ribs.

16. A light fixture mounting assembly as defined in claim 15 in which the housing and lamp module comprise aluminum.

17. A light fixture mounting assembly as defined in claim 15 in which the lamp module comprises LED lamps and is configured to conduct heat from the LED lamps into the housing sidewall and from the housing sidewall into the ribs.

18. A light fixture mounting assembly for supporting a light fixture in a panel having a through-hole for receiving such a fixture, the assembly comprising:

a lamp housing having a sidewall and an opening defined by a rim at one end of the sidewall, the housing being configured to be received into an installed position in a hole in a panel and further comprising a detent extending outward from the sidewall in a position to engage a lower surface of the panel when the housing is in the installed position; and a spring clip carried by the lamp housing and comprising an arm and a spring that biases the arm downward into a deployed position against an upper surface of the panel in such a way as to bias the lamp housing upward toward the installed position, the arm being rotatable against spring bias to an upwardly-extending cocked position allowing the retainer to pass through the hole when the housing is inserted through the hole into the installed position.

19. A light fixture mounting assembly for supporting a light fixture in a panel having a through-hole for receiving such a fixture, the assembly comprising:

a lamp housing having a sidewall and an opening defined by a rim at one end of the sidewall, the housing being receivable into an installed position in a hole in a panel and further comprising a detent extending outward from the sidewall in a position to engage a lower surface of the panel when the housing is in the installed position; and a spring clip carried by the lamp housing and comprising an arm that engages the panel in such a way as to bias the lamp housing upward toward the installed position, and that is biased toward a deployed position in which a distal end of the arm engages the upper surface of a panel when the housing is in the installed position in a hole in the panel, the distal end of the arm including a claw configured to engage the panel in such a way as to resist rotation of the housing within the panel hole.

20. A light fixture mounting assembly as defined in claim 19 in which the claw of the spring clip arm includes a wire bent to form at least two tines at the distal end of the arm.

* * * * *